US005733227A

United States Patent [19]

Lee

[11] Patent Number: 5,733,227

[45] Date of Patent: Mar. 31, 1998

[54] STEP EXERCISER

[76] Inventor: Kuo-Lung Lee, No. 61, Mai Jou II Rd., Yi Lan City, Taiwan

[21] Appl. No.: 870,258

[22] Filed: Jun. 6, 1997

[51] Int. Cl.[6] ..... A63B 69/16

[52] U.S. Cl. ..... 482/52; 482/51

[58] Field of Search ..... 482/51, 52, 53, 482/57, 62, 70, 71, 111, 60, 72

[56] References Cited

U.S. PATENT DOCUMENTS 4,850,585 7/1989 Dalebout ..... 482/52
5,190,505 3/1993 Dalebout et al. ..... 482/52
5,518,473 5/1996 Miller ..... 482/57
5,577,985 11/1996 Miller ..... 482/51

*Primary Examiner*—Stephen R. Crow
*Attorney, Agent, or Firm*—Varndell Legal Group

[57] ABSTRACT

A step exerciser including a belt pulley rotatably supported on a base frame, a damping wheel coupled to the belt pulley by a belt, two pedals adapted for propelling the belt pulley, the pedals having a respective front end coupled to the belt pulley by a respective crank and a respective rear end terminating in a respective foot plate and a respective pair of upright lugs in the middle, and two handlebars respectively turned about an axis above the elevation of the wheel center of the belt pulley and having a respective bottom end respectively pivoted to the lugs of the pedals.

1 Claim, 6 Drawing Sheets

STEP EXERCISER

BACKGROUND AND SUMMARY OF THE INVENTION

The present invention relates to exercising apparatus, and more particularly to such a step exerciser which enables the user to exercise jogging when operated.

A variety of exercising apparatus such as step exercisers, jogging exercisers, sliding exercisers, stationary bicycles, etc., have been disclosed for exercising the muscles of the legs. A regular step exerciser may be equipped with handlebars for the holding of the hands when stepping, however these handlebars are not designed for exercising the hands. Further, regular jogging exercisers (U.S. Pat. No. 4,850,585, for example) and sliding exercisers can not satisfy the need for a heavy exercising amount because the legs are simply oscillated in a smoothly curved path when exercising.

The present invention has been accomplished to provide a step exerciser which eliminates the aforesaid drawbacks. It is one object of the present invention to provide a step exerciser which enables the user to exercise the legs as well as the hands. It is another object of the present invention to provide a step exerciser which enables the user to exercise jogging. It is still another object of the present invention to provide a step exerciser which can not be adjusted to fit different demands for different exercising amount. According to the preferred embodiment of the present invention, the step exerciser comprises a belt pulley rotatably supported on a base frame, a damping wheel coupled to the belt pulley by a belt, two pedals adapted for propelling the belt pulley, the pedals having a respective front end coupled to the belt pulley by a respective crank and a respective rear end terminating in a respective foot plate and a respective pair of upright lugs in the middle, and two handlebars respectively turned about an axis above the elevation of the wheel center of the belt pulley and having a respective bottom end respectively pivoted to the lugs of the pedals. When the user steps on the pedals up and down alternatively, the handlebars are pushed and pulled to move the pedals back and forth, and at the same time the belt pulley is turned by the pedals to rotate the damping wheel.

DETAILED DESCRIPTION OF THE PREFERRED EMBODIMENT

Figure 1:
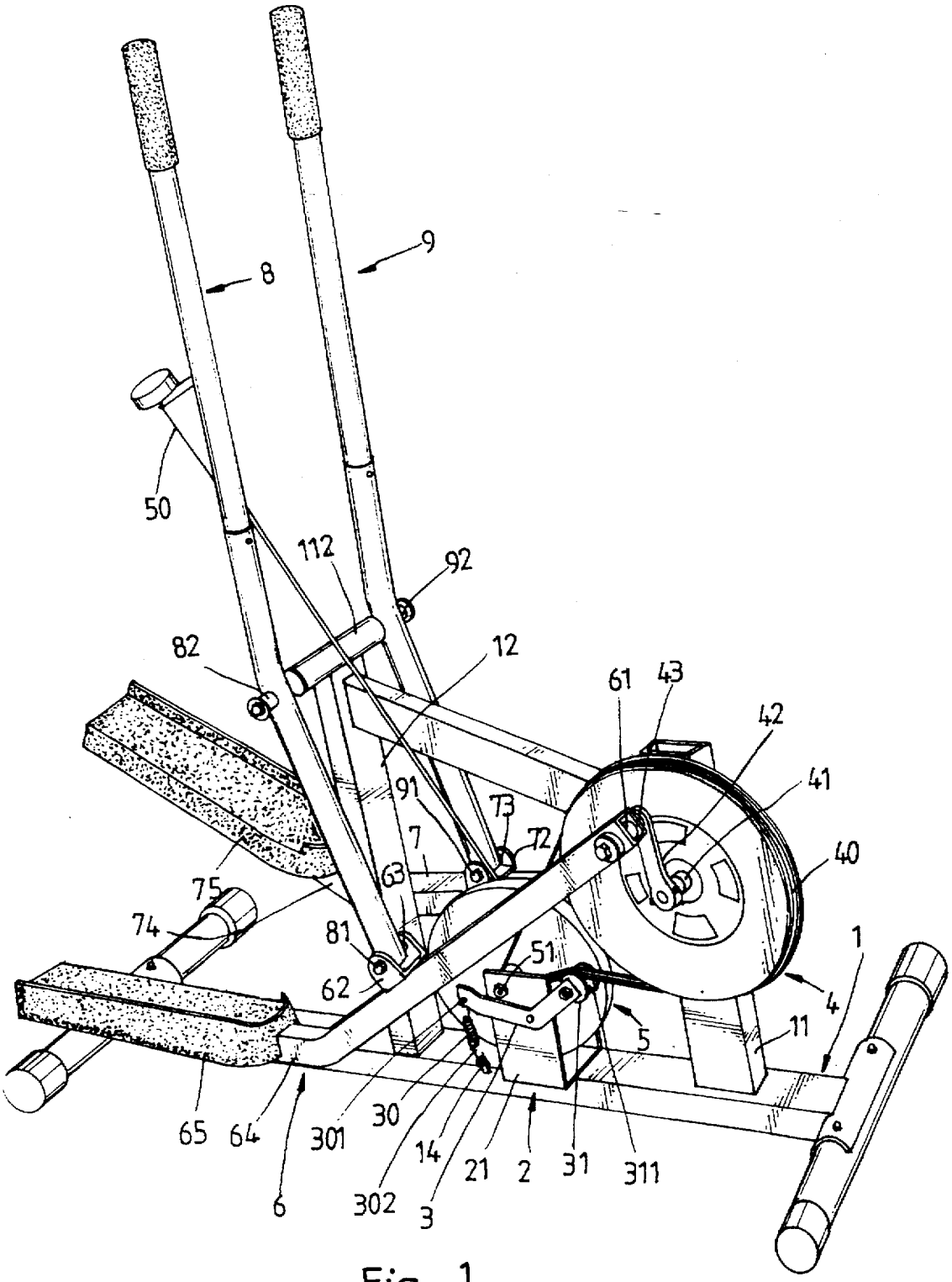
FIG. 1 is a perspective elevational view of a step exerciser according to the present invention.
Figure 2:
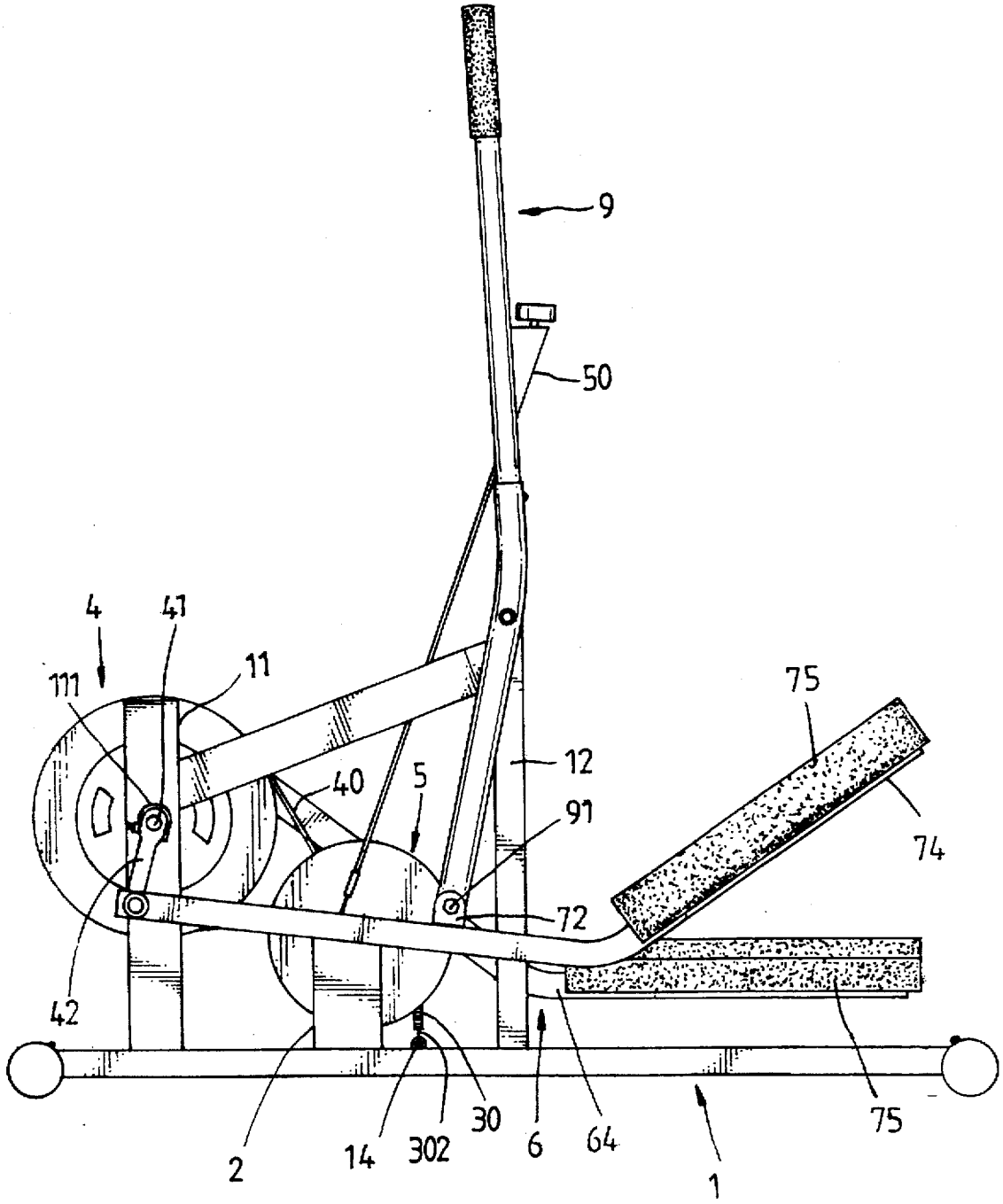
FIG. 2 is a side view of the step exerciser shown in FIG. 1.
Figure 3:
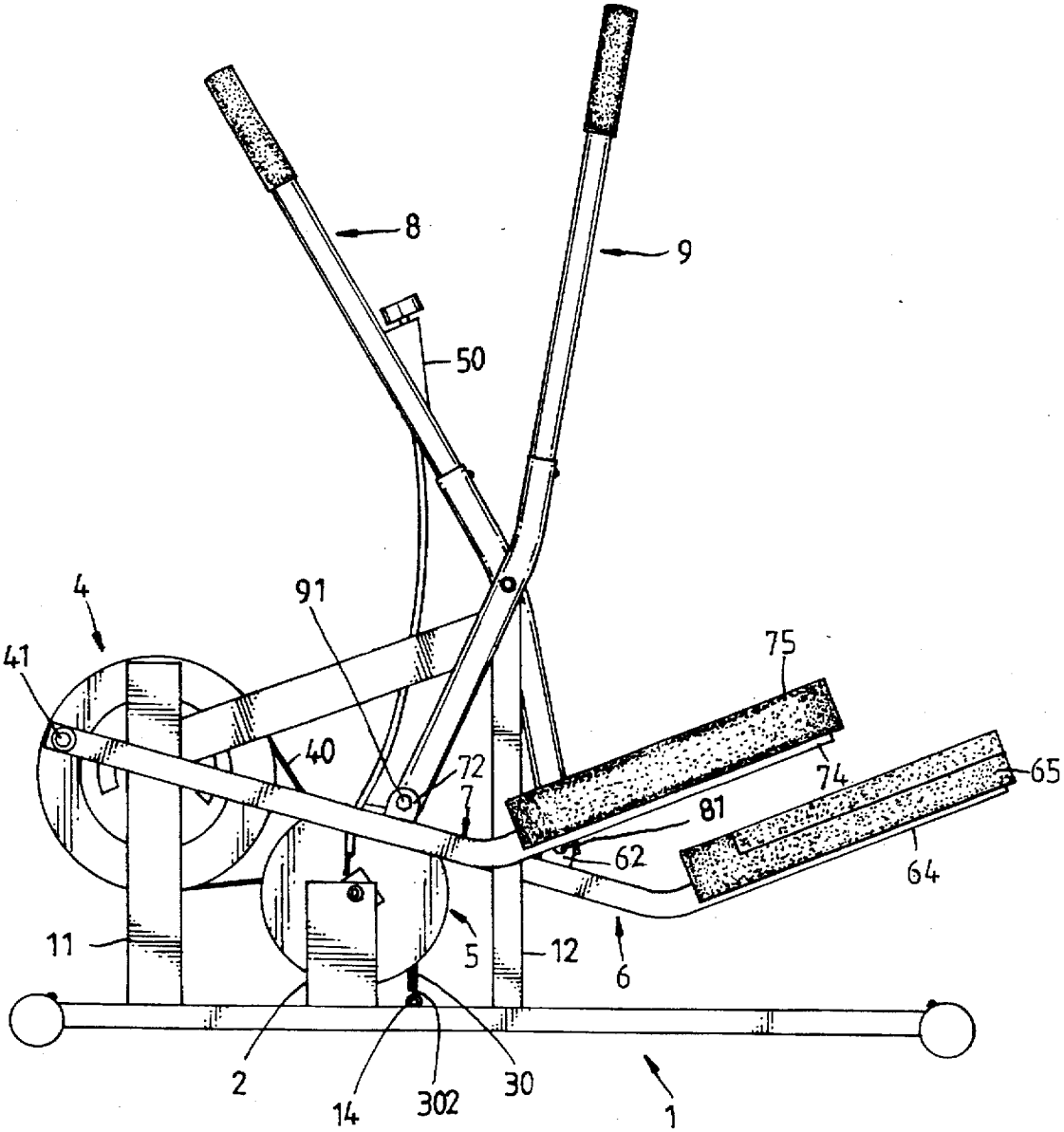
FIG. 3 is another side view of the present invention, showing the step exerciser operated.
Figure 4:
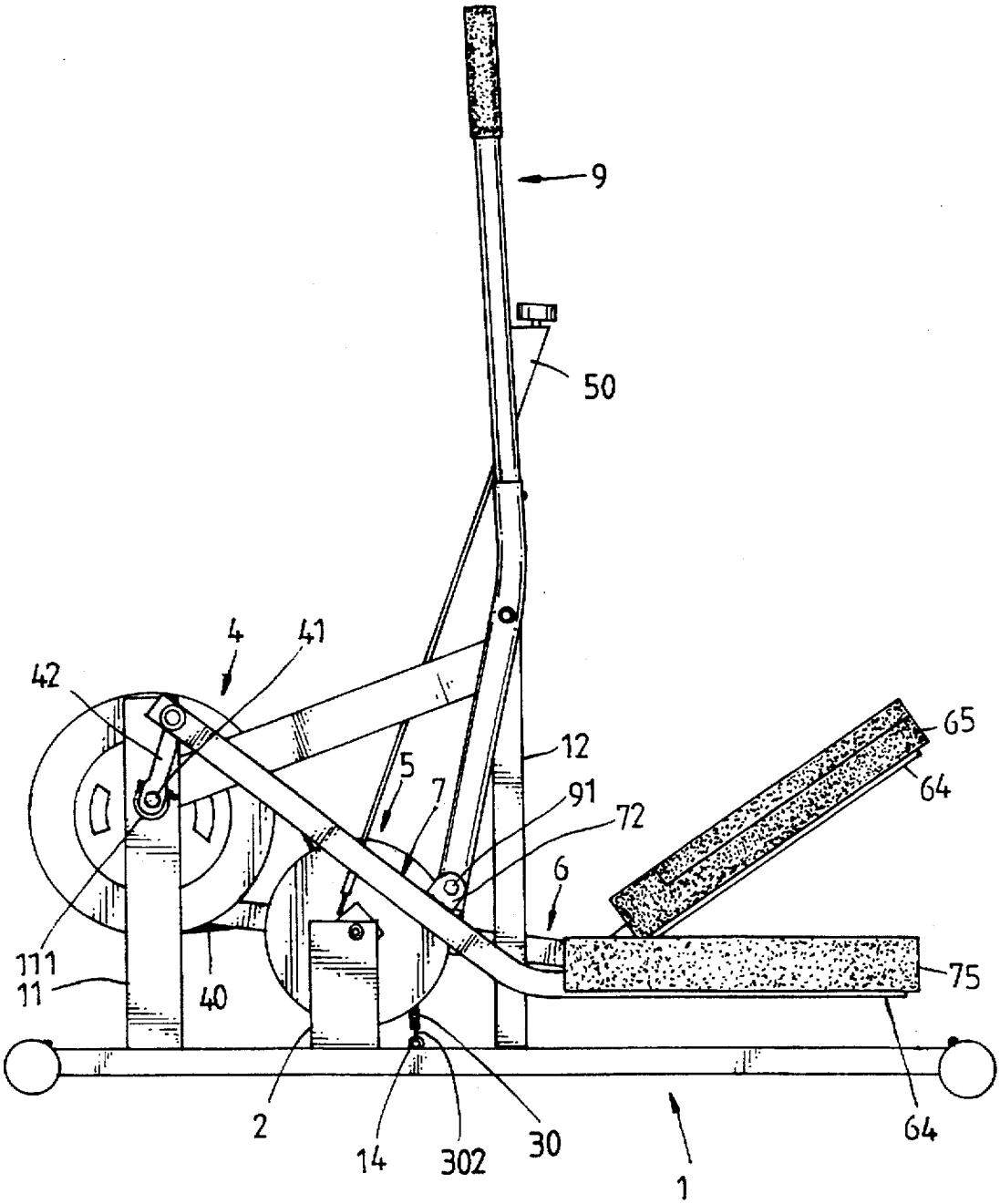
FIG. 4 is another side view of the present invention, showing the step exerciser operated.
Figure 5:
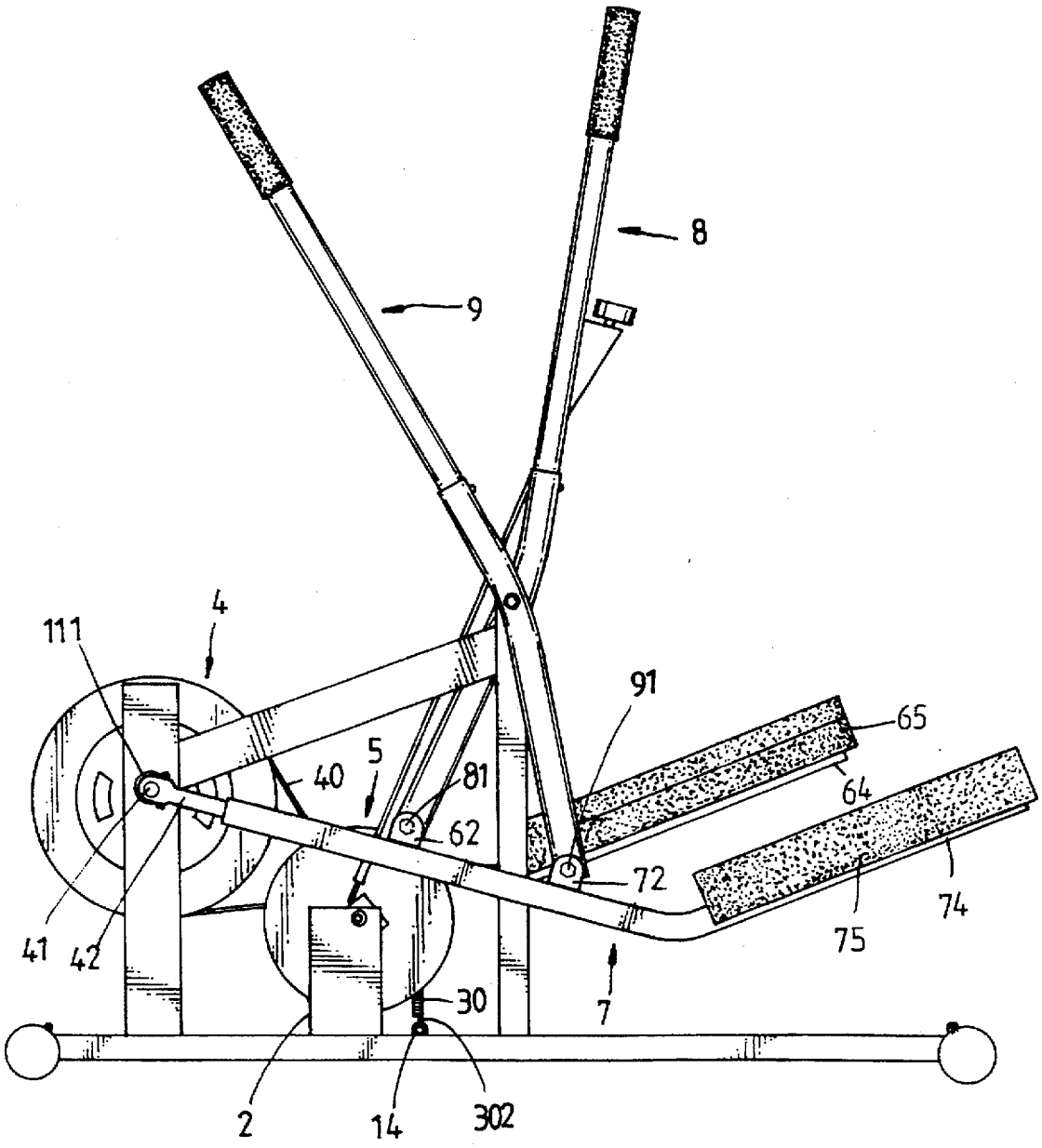
FIG. 5 is another side view of the present invention, showing the step exerciser operated.

Referring to FIGS. from 1 to 6, a step exerciser according to the present invention comprises, a base frame 1, a U-frmae 2, an idle wheel holder 3, a belt pulley 4, a transmission belt 40, a damping wheel 5, a damping device, an adjustment device 50, two pedals (6, 7) and two handlebars (8, 9).

The base frame 1 comprises a front upright 11, a front axle housing 111 transversely mounted on the front upright 11, a rear upright 12, and a rear axle housing 112 transversely mounted on the rear upright 12.

The U-frame 2 is fixedly mounted on the base frame 1 and spaced between the front upright 11 and the rear upright 12.

The idle wheel holder 3 is a curved rod having a middle part pivoted to one side 21 of the U-frame 2, a front end equipped with an idle wheel 31, and a rear end connected to the base frame 1 by a spring 30. The spring 30 has a top end 301 connected to the rear end of the idle wheel holder 3, and a bottom end 302 connected to a hook 14 on the base frame 1.

The belt pulley 4 comprises a fixed center axle 41 rotatably supported on the front axle housing 111 of the front upright right 11, two links 42 respectively connected to two opposite ends of the fixed center axle 41 at right angles, and two pivots 43 respectively and perpendicularly mounted on the links 42 at one end remote from the fixed center axle 41.

The damping wheel 5 has a fixed wheel hub rotatably supported on an axle 51 on the U-frame 2.

The transmission belt 40 is mounted on the belt pulley 4 and the fixed wheel hub of the damping wheel 5, and supported on the periphery 311 of the idle wheel 31. When the belt pulley 4 is rotated, the transmission belt 40 is turned to rotate the damping wheel 5.

The damping device (not shown) is mounted on the U-frame 2, and imparts a resisting force to the damping wheel 5. The resisting force of the damping device can be adjusted through the adjustment device 50.

The pedals (6, 7) have a respective front end 61 respectively pivoted to the pivoted 43, a respective rear end (64, 74) sloping upwards and terminating in a respective foot plate (65, 75) and a respective pair of upright lugs (62, 72) with respective pivot holes (63, 73) at the top in the middle.

The handlebars (8, 9) have a respective middle part respectively pivoted to the rear axle housing 112 by a respective pivot (82, 92) and a respective bottom end respectively pivoted to the pivot holes (63, 73) of the upright lugs (62, 72) of the pedals (6, 7) by a respective pivot (81, 91). The pivots (82, 92) are disposed at a higher elevation than the fixed center axle 41 of the belt pulley 4. The pivots (81, 91) are disposed at a lower elevation than the fixed center axle 41 of the belt pulley 4.

Referring to FIGS. from 2 to 5, when the user alternatively steps on the pedals (6, 7), the handlebars (8, 9) are alternatively pushed and pulled. When the pedals (6, 7) are alternatively pedaled, the belt pulley 4 is continuously rotated, and the damping wheel 5 is turned by the belt pulley 4 through the transmission belt 40, and at the same time the damping device provides a resisting force to the damping wheel 5. Because the pivots (81, 91) are disposed at a lower elevation then the fixed center axle 41 of the belt pulley 4 and the pivots (82, 92) are disposed at a higher elevation then the fixed center axle 41 of the belt pulley 4, the user's arms and legs are turned up and down in a curved course simulating a jogging exercise.

Figure 6:
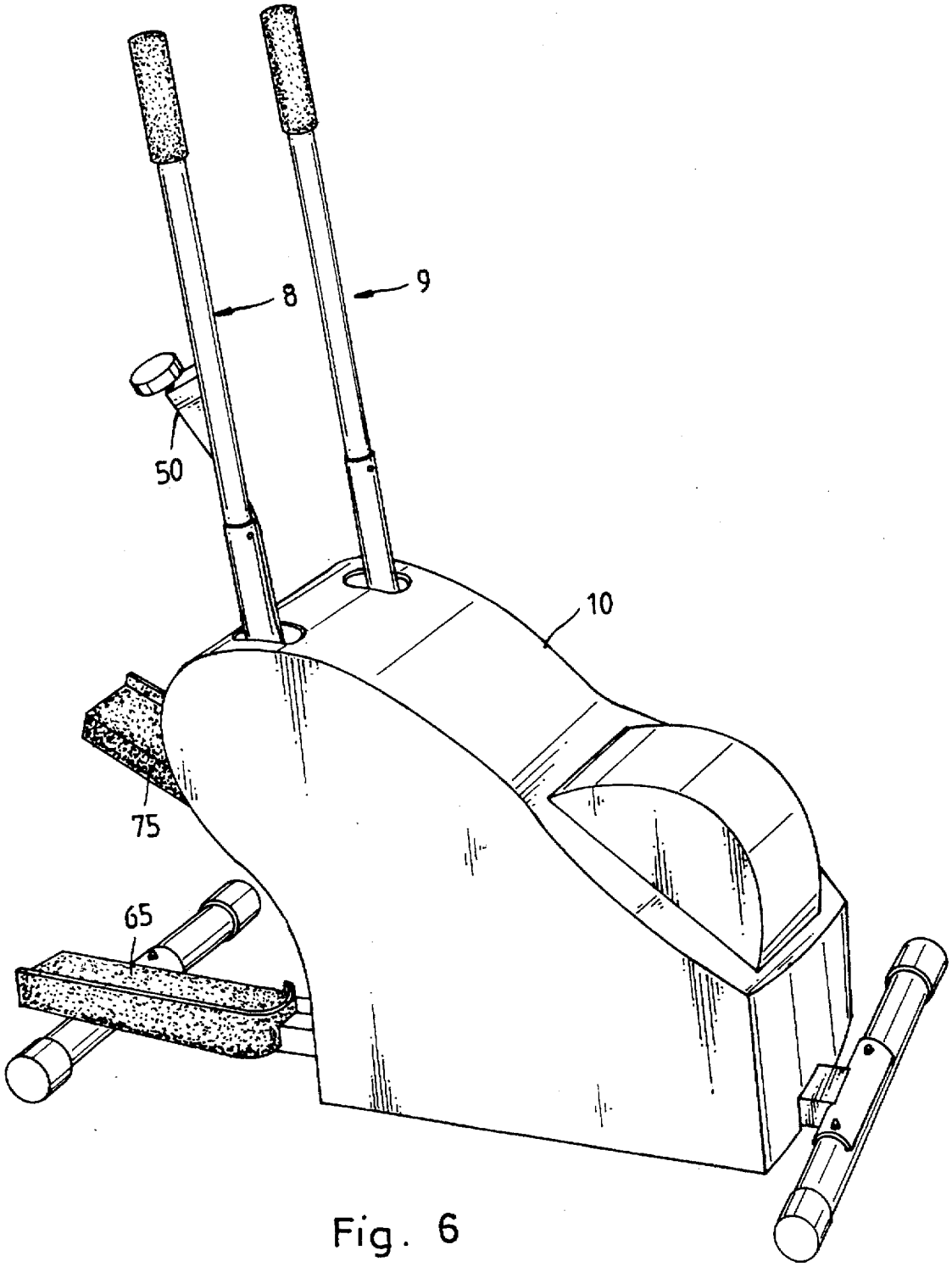
FIG. 6 shows a cover mounted on the step exerciser for protection.

Referring to FIG. 6, the step exerciser may be equipped with a cover 10 for protection.

I claim:

1. A step exerciser comprising:

a base frame having a front upright, a front axle housing transversely mounted on said front upright, a rear upright, and a rear axle housing transversely mounted on said rear upright at a lower elevation then said front axle housing;

a U-frame fixedly mounted on said base frame and spaced between said front upright and said rear upright;

an idle wheel holder having a middle part pivoted to one side of said U-frame, a front end equipped with an idle wheel, and rear end connected to a hook on said base frame by a spring;

a belt pulley having a fixed center axle rotatably supported on said front axle housing of said front upright right;

a damping wheel having a fixed wheel hub rotatably supported on an axle of said U-frame;

a transmission belt mounted on said belt pulley and said fixed wheel hub of said damping wheel, and supported on said idle wheel for transmitting rotary power from said belt pulley to said damping wheel;

damping means adapted to impart a resisting force to said damping wheel;

adjustment means adapted to adjust the resisting force of said damping means to said damping wheel;

two pedals bilaterally coupled to said belt pulley and adapted to be stepped upon by the user to turn said belt pulley, said pedals having a respective front end, a respective rear end sloping upwards and terminating in a respective foot plate, and a respective pair of upright lugs in the middle;

two links repectively coupled between the front ends of said pedals and two opposite ends of the fixed center axle of said belt pulley; and two handlebars having a respective middle part respectively pivoted to two opposite ends of said rear axle housing by a respective pivot, and a respective bottom end respectively pivoted to the upright lugs of said pedals by a respective pivot at an elevation lower than the fixed center axle of said belt pulley.

* * * * *